United States Patent [19]

Stevenson

[11] 4,183,285

[45] Jan. 15, 1980

[54] ROTARY CONTROL VALVE FOR EXPANSION FLUID ENGINES

[75] Inventor: Robert L. Stevenson, Overland Park, Kans.

[73] Assignee: Havaco Incorporated, Overland Park, Kans.

[21] Appl. No.: 923,184

[22] Filed: Jul. 10, 1978

[51] Int. Cl.[2] ..... F01L 33/02; F01L 31/20

[52] U.S. Cl. ..... 91/180; 91/187

[58] Field of Search ..... 91/180, 187, 484, 485

[56] References Cited

U.S. PATENT DOCUMENTS

| | | | |
|---|---|---|---|
| 361,598 | 4/1887 | Rosenkranz | 91/180 |
| 470,978 | 3/1892 | Bruce | 91/180 |
| 513,650 | 1/1894 | Ofeldt | 91/180 |
| 878,578 | 2/1908 | Thompson . | |
| 991,699 | 5/1911 | Cassady | 91/180 |
| 1,038,970 | 9/1912 | Rydberg . | |
| 1,053,414 | 2/1913 | Ludwick . | |
| 2,131,216 | 9/1938 | Brooke . | |
| 2,503,086 | 4/1950 | Albright . | |
| 3,068,012 | 12/1962 | Van Vleet . | |
| 3,608,308 | 9/1971 | Cary et al. . | |
| 3,696,710 | 10/1972 | Ortelli | 91/180 |
| 3,893,295 | 7/1975 | Airas . | |
| 4,045,978 | 9/1977 | Abrahams et al. . | |

FOREIGN PATENT DOCUMENTS

| | | | |
|---|---|---|---|
| 649881 | 10/1962 | Canada | 91/180 |

*Primary Examiner*—Paul E. Maslousky

*Attorney, Agent, or Firm*—Fishburn, Gold & Litman

[57] ABSTRACT

A rotary control valve for expansion fluid driven engines comprises a housing having inlet and outlet ports, a distribution port positioned at one end of the housing and communicating with the engine cylinder, and a first sealing face disposed about the distribution port. A rotor is mounted in the housing on a drive shaft, rotates therewith, and is capable of translating axially thereon. The rotor includes pressure and exhaust passageways which alternately communicate with the distribution port to pressurize and exhaust the engine cylinder. A second sealing face is positioned on the rotor about one end of the pressure and exhaust passageways, and mates with the housing sealing face to form a sliding seal therebetween. A seal ring is positioned between the periphery of the rotor and the housing, and divides the cavity defined therebetween into separate intake and exhaust chambers which respectively communicate with the intake and exhaust ports. The housing and rotor sealing faces are disposed within the exhaust chamber, such that operational fluid pressure urges the sealing faces abuttingly together with automatically varying compression, and forms a secure sliding seal sequentially between the distribution port and the pressure and exhaust passageways for efficient engine operation.

10 Claims, 5 Drawing Figures

ROTARY CONTROL VALVE FOR EXPANSION FLUID ENGINES

BACKGROUND OF THE INVENTION

This invention relates to expansion fluid driven engines, and in particular to a control or distribution valve therefor.

Expansion fluid engines, such as open system steam driven engines, closed system Freon driven engines, and other types of engines which are driven by expanding gases or liquids, are generally known in the art. Such engines require a control valve to control the flow of the working fluid through the engine, and to selectively distribute the pressurized fluid to the various expansion chambers of multi-cylinder engines. The efficient and accurate control of the working fluid is essential to accomplish good engine economy.

SUMMARY OF THE INVENTION

The principal objects of the present invention are: to provide a rotary valve for expansion fluid engines which efficiently controls the flow of pressurized fluid through the engine cylinders; to provide such a valve which evenly distributes pressurized fluid to a plurality of cylinders in a multi-cylinder engine; to provide such a valve having a secure seal between pressurized and exhaust portions of the valve chamber with automatically varying seal compression; to provide such a valve having a reduced number of moving parts; to provide such a valve which prevents fluid leakage and blow-by; to provide such a valve which is balanced for smooth operation; to provide such a valve which is compact and lightweight; to provide such a valve adapted to deliver maximum power from an expandable fluid, such as steam, Freon, or the like; to provide such a valve wherein operational fluid pressure urges mating sealing faces together to form a secure sliding seal between the various valve ports; to provide such a valve having a spring member which independent of operating pressure resiliently and constantly urges the seaing faces together for seal security; to provide such a valve which is easily adjusted to vary engine timing; to provide such a valve having a rotor with an O-ring and a mating sliding sleeve thereon which forms a sliding end seal to prevent communication between the pressure and exhaust portions of the valve chamber; to provide such a valve which is particularly adapted for use in opposingly timed, two-cylinder engines; and to provide such a valve which is durable in construction, economical to manufacture, positive in operation, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENTS

As required, detailed embodiments of the present invention are disclosed herein, however it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
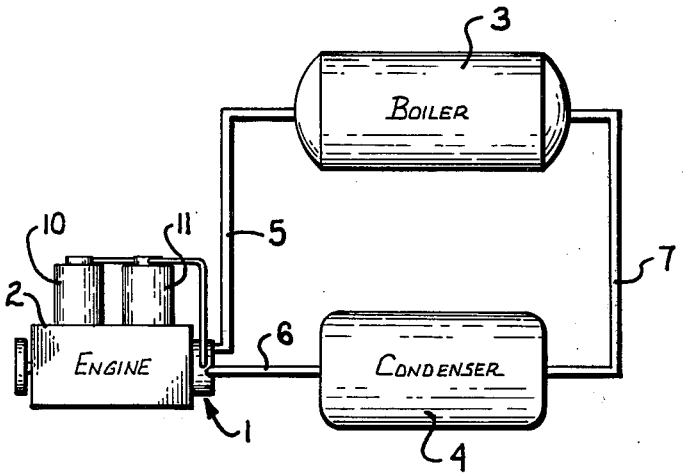
FIG. 1 is a schematic illustration of an expansion fluid engine system, and rotary valve therefor embodying the present invention.
Figure 2:
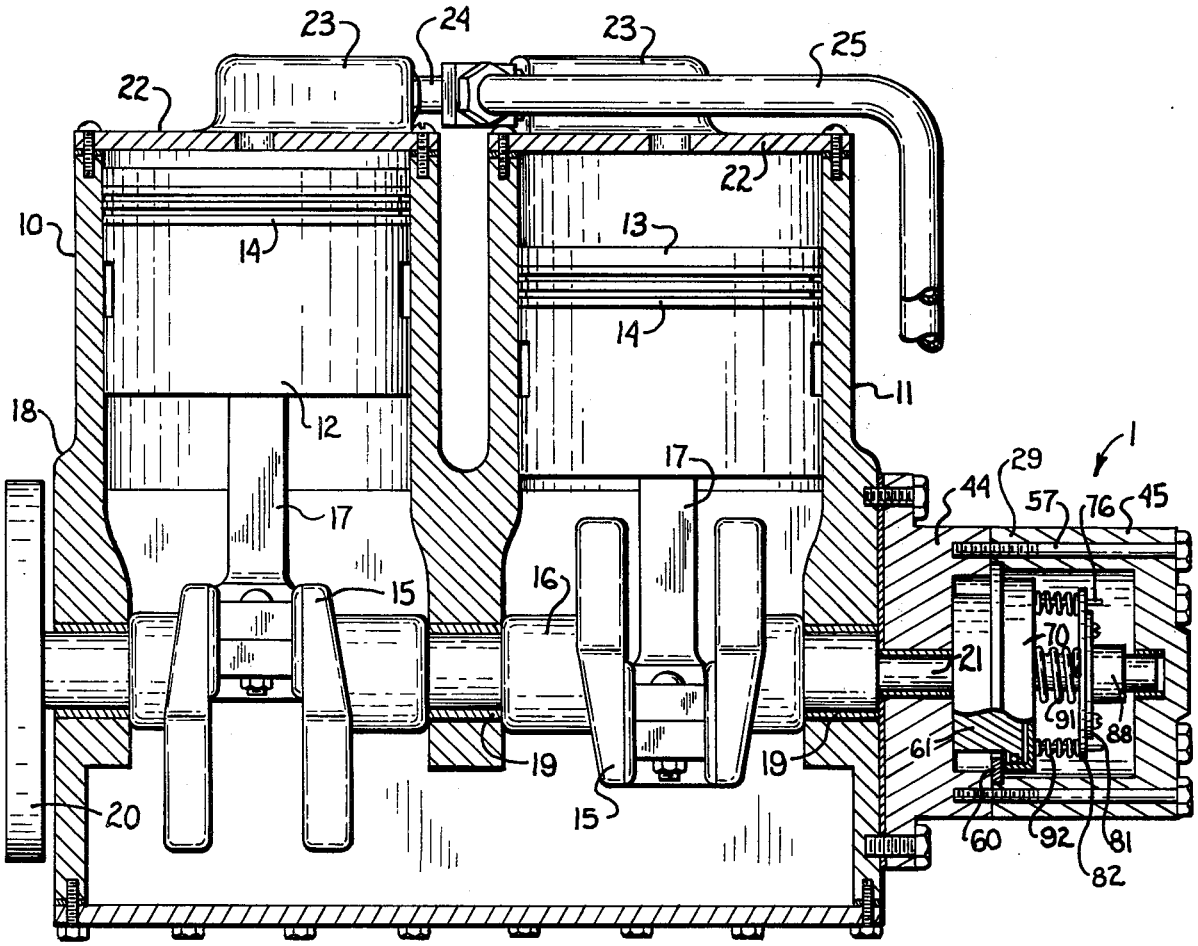
FIG. 2 is a vertical cross-sectional view of the engine and the valve with portions thereof broken away to reveal internal construction.

For purposes of description herein, the terms "upper", "lower", "right", "left", "rear", "front", "vertical", "horizontal", and derivatives thereof shall relate to the invention as oriented in FIG. 2, however, it is to be understood that the invention may assume various alternative orientations, except where expressly specified to the contrary.

The reference numeral 1 generally designates a rotary control valve for an expansion fluid driven engine 2 having at least one cylinder with a piston therein. The expansion fluid driven engine may comprise a steam engine, a hot gas engine, or the like, and in the illustrated example, is driven by a closed, Freon system having a boiler 3 and a condenser 4. The Freon disposed in the boiler 3 is heated by a outside source of energy, such as an electrical element, fossil fuel combustion, solar energy, or the like, thereby pressurizing the Freon gas which is directed through a conduit 5 to each of the engine cylinders by the control valve 1. The spent or exhaust gases are directed through conduit 6 from the valve 1 to a condenser wherein the spent gases are condensed to a liquid state. After the gases have been condensed, they are reintroduced through conduit 7 into the boiler 3, thereby completing the closed system.

The illustrated engine 2 includes a pair of opposingly timed cylinders 10 and 11, each having a piston 12 and 13 respectively, slidably mounted therein. Each of the pistons includes a plurality of concentrically arranged, spaced apart compression rings 14, and is connected to a throw portion 15 of a crank shaft 16 by an associated connecting rod 17. The crank shaft 16 is rotatably mounted in the engine block 18 by spaced apart main bearings 19, and includes a fly wheel 20 connected with the forward end thereof, and a rear shaft portion 21 connected with the rotary control valve 1. The illustrated cylinders have a relatively short stroke, wherein the stroke is equal to or less than 60% of the piston diameter. Each of these cylinders 10 and 11 includes a head member 22 with a fitting 23 disposed centrally therein to communicate the working fluid with the cylinder. The cylinders 10 and 11 are connected to the control valve 1 by a separate conduit member 24 and 25 respectively.

The rotary control valve 1 comprises a housing 29 (FIG. 3) having an inlet port 30, an outlet port 31, at least one distribution port 32 positioned in one end of the housing and communicating with one of the engine cylinders, and a first sealing face 34 disposed about the distribution port 32. A rotor assembly 35 is mounted in the housing 29 on the rear drive shaft 21, rotates therewith, and may slide or translate axially thereon. The rotor assembly 35 includes pressure and exhaust passageways 36 and 37 respectively, which alternately communicate with the distribution port 32 to pressurize and exhaust the associated engine cylinder. A second sealing face 38 is positioned on the rotor assembly 35 about one end of the pressure and exhaust passageways 36 and 37 and mates with the housing sealing faces 34 to form a sliding seal therebetween. A seal ring or member 39 is positioned between the periphery of the rotor assembly 35 and the housing 29, and divides the cavity 40 defined therebetween into separate intake and exhaust chambers 41 and 42 which respectively communicate with the inlet and outlet ports 30 and 31. The housing and rotor sealing faces 34 and 38 are disposed within the exhaust chamber 42, whereby operational fluid pressure urges the sealing faces abuttingly together and forms a secure sliding seal sequentially between the distribution port 32 and the pressure and exhaust passageways 36 and 37. The compression between the sealing faces 34 and 38 automatically varies for low, intermediate, and high engine operating pressures.

Figure 5:
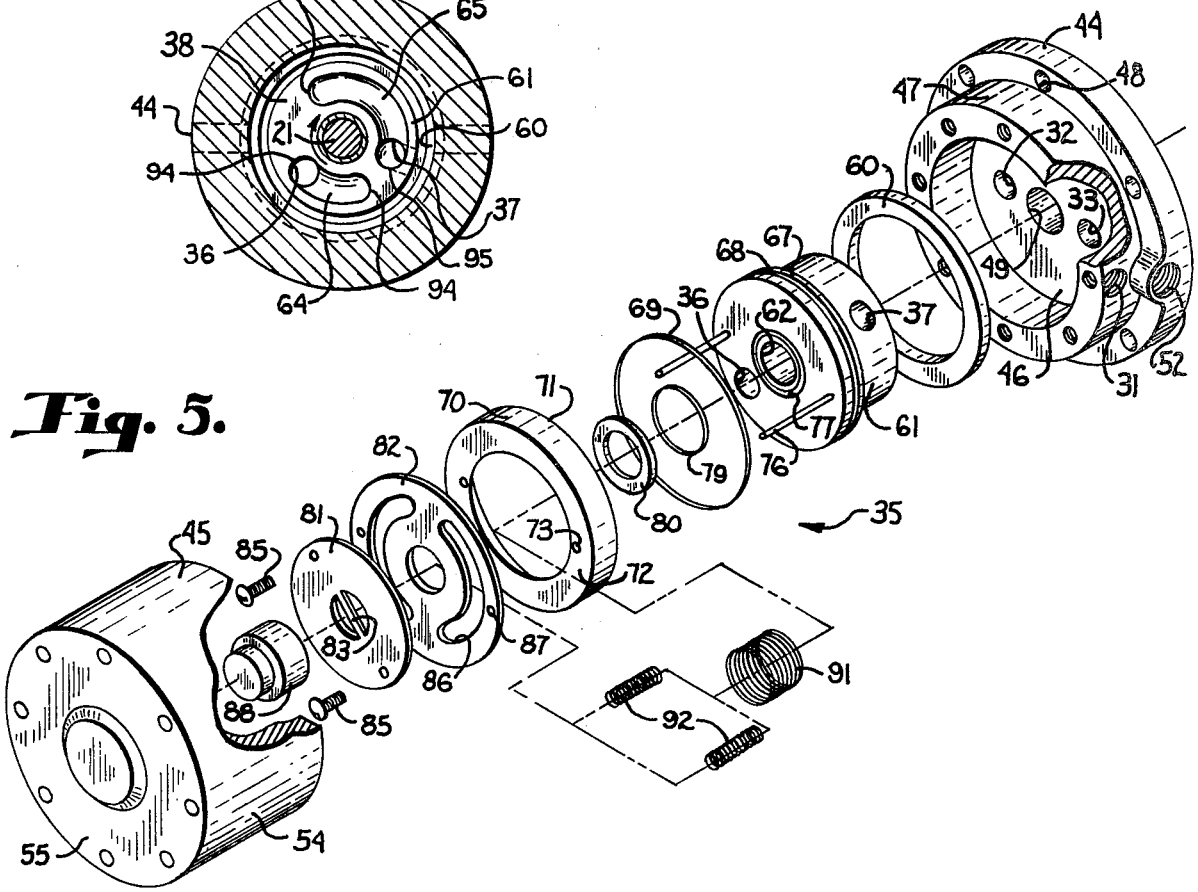
FIG. 5 is an exploded, perspective view of the rotary valve.

The illustrated housing 29, as best shown in FIG. 5, is a cylindrical, two-piece structure, having a base 44 and an end closure 45. The base 44 comprises an end plate 46 having a cylindrically shaped side wall 47 connected therewith. The outer peripheral edge of the end plate 46 extends outwardly of the side wall to form a flange having a plurality of circumferentially spaced apertures 48 adapted to receive fasteners therethrough to attach the valve to the engine block 18. The end plate 46 includes a concentrically positioned bore 49 through which the drive shaft 21 is received. A distribution port is provided with each cylinder of the engine, and the present valve includes two ports 32 and 33 which respectively communicate with the engine cylinders 10 and 11. The illustrated ports 32 and 33 are circular in shape, positioned diametrically opposite and equidistantly of the rotor drive shaft bore 49, and are oriented along a substantially horizontal plane on the sides of the valve 1. It is to be understood that the positioning of the distribution ports 32 and 33 is selected in accordance with the crank shaft design and the timing of the various pistons of a multi-cylinder engine. The interior surface of the end plate 46 forms a first sealing surface or face and is constructed extremely planar and smooth by means such as precision lapping. The outlet port 31 is positioned radially through the base side wall 47 and is connected with the conduit member 6. The inlet port 30 is positioned radially through the end closure 45 adjacent the end plate 55, and is connected with the conduit member 5. The distribution ports 32 and 33 communicate with separate passageways 50 and 51 respectively which extend radially through the base end plate 46 and terminate on opposite sides of the flange with a threaded bore 52 shaped to receive a fitting 53 therein to connect the same to the associated conduit 24 and 25.

The base end closure 45 comprises a side wall 54 and end plate 55, which in the illustrated example, is of a one-piece construction. The interior surface of the closure side wall 54 is cylindrical in shape, and the end plate 55 includes a concentrically positioned aperture and bearing 56 for purposes to be described hereinafter. The end edges of the base and closure side walls 47 and 54 mate in a sealing fashion, and circumferentially spaced fasteners 57 detachably interconnect the same. The interior surface of the closure side wall 54 includes a step or shoulder positioned adjacent to the end edge thereof, and forms a groove 58 with the mating end edge of the base side wall 47.

An annularly shaped ring 60 is positioned in the groove 58 abutting the end closure shoulder, and extends radially inwardly of the interior surface of the housing side wall 54. The ring 60 includes a central aperture through which the rotor assembly 35 is positioned, and divides the housing cavity 40 into the intake chamber 41 and the exhaust chamber 42. The inlet port 30 communicates with the intake chamber 41, and the outlet port 31 communicates with the exhaust chamber 42. In the illustrated Freon system, the inlet port 30 is connected with the boiler conduit 5, and the outlet port 31 is connected with the condenser conduit 6.

Figure 4:
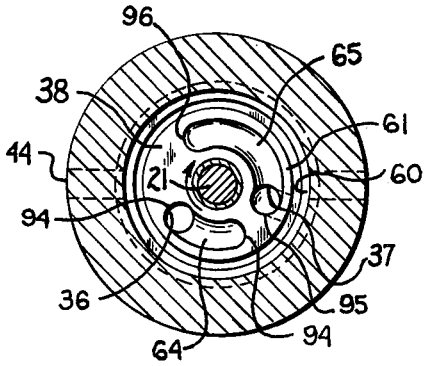
FIG. 4 is a vertical cross-sectional view of the valve taken along line 4—4, FIG. 3.

The rotor assembly 35 includes a substantially cylindrically shaped body or rotor 61, and is mounted within the valve housing 20 on the drive shaft rear portion 21. The illustrated rotor includes a central bore 62 which mates with the drive shaft 21 and slides thereon. As best illustrated in FIG. 4, the rotor sealing surface 38 is a precision lapped, planar sealing face which abuts and mates with the housing sealing face 34. The rotor sealing face 38 includes the pressure passageway 36 which extends axially through the rotor to an outer end portion 63 thereof, and selectively communicates the distribution ports 32 and 33 with the intake chamber 41. The pressure passageway 36 includes a channel or recess 64 having an arcuate radial cross-sectional shape, and extends concentrically about the drive shaft 21 counterclockwise from the passageway (as viewed in FIG. 4), an arcuate distance in the nature of 96 degrees. The channel 64 provides for extended communication between the pressurized fluid and the expansion chamber of the cylinder during the expansion stroke for increased power, and further provides means for starting the engine without an external starter. The exhaust passageway 37 extends from the sealing surface 38 inwardly into the rotor a spaced apart distance, and angles normally thereto in a radial fashion through the peripheral surface of the rotor, and communicates with the exhaust chamber 42. The exhaust passageway 37 exits at a medial portion of the exhaust chamber 42, which is in substantial alignment with the outlet port 31. The exhaust passageway 37 also includes a channel or recess 65 which extends counterclockwise of the exhaust passageway (as viewed in FIG. 4), has an arcuate radial cross-sectional shape, and extends concentrically with respect to the drive shaft 21. The channel 65 extends an arcuate distance in the nature of 151 degrees, and facilitates complete cylinder purging during the exhaust stroke. In this example, the pressure and the exhaust passageways 36 and 37 are spaced approximately 120 to 130 degrees apart.

The rotor 61 further includes a flange portion 67 positioned at the rotor end opposite the sealing face 38. The flange 67 includes a peripheral groove 68 in which an O-ring seal 69 is mounted. A sleeve 70 is sealingly mounted on the O-ring 69 and is slidable and concentric therewith. The sleeve 70 includes an end edge 71 which abuts the ring 60, whereby operational fluid pressure urges the sleeve end edge 71 against the ring 60 and forms a sliding seal therebetween with automatically varying compression. The exterior surface of the sleeve 70 is spaced slightly from the interior surface of the closure side wall 45, and is slidable with respect to both the rotor 61 and the shaft 21, whereby accommodation for wear between the abutting surfaces is accomplished automatically. The illustrated sleeves 70 includes a radially inwardly directed flange 72 having a pair of apertures 73 exposed on diametrically opposite sides thereof for purposes to be described hereinafter.

The rotor assembly 35 also includes a spring assembly 75 mounted within the housing 29, and resiliently and constantly urges both the rotor 61 and the sleeve 70 against their respective sealing surface, independent of engine fluid pressure, to achieve seal security even during low operating engine pressures. In this example, the spring assembly 75 comprises a pair of elongate pins 76 having one end thereof fixedly attached in the outer end 63 of the rotor 61 at opposing sides thereof. The pins 76 extend through the sleeve apertures 73 rearwardly toward the housing end plate 55. In addition to the pins, a groove 77 is positioned in the rotor end 63 concentrically about the drive shaft bore 62, and includes an O-ring 79 mounted therein. A flat washer 80 is positioned over the drive shaft 21 and mates with the O-ring 79 to form a seal about the shaft. A pair of plates 81 and 82 are slidably positioned on the shaft 21 rearwardly of the sleeve 70, and function to connect the rotor 61 to the shaft 21, and to provide means for applying resilient forces to the rotor 61 and the ring 70. In the illustrated example, the plates 81 and 82 have a circular shape and are adjustably interconnected to vary the timing of the engine. The outer plate 81 includes a central aperture with a bar 83 disposed diametrically thereacross which mates with a slot 84 in the terminal end of the shaft 21, whereby the plate 81 rotates with the shaft, but may slide axially thereon. The inner plate 82 is attached to the first plate 81 by a pair of fasteners 85 which extend through circumferentially elongated slots 86, whereby the fasteners 85 may be loosened and the relative radial relationship between the plates 81 and 82 varied. The inner plate 82 further includes a pair of apertures 87 through which the pins 76 extend, thereby connecting the rotor 61 with the shaft 21 for rotation, yet permitting axially translation thereon. A hub 88 is threadedly connected with the terminal end of the shaft 21, and includes a forward edge which abuts the first plate 81 to restrict translation on the shaft, and a journal end 90 which is rotatably mounted in the bearing 56. A coil spring 91 is mounted on the shaft, and extends between the inner plate 82 and the washer 80 and is adjusted or compressed to apply inward pressure to the washer 80 thereby forming a seal with the O-ring 79 to prevent leakage about the shaft 21, and further urges the planar sealing surfaces 34 and 38 together. Smaller coil springs 92 are mounted on each of the pins 76 and extend between the inner plate 82 and the sleeve flange 72. The position of the plates 81 and 82 is adjusted such that the springs 92 are compressed and urge the sealing sleeve 70 against the ring 58. The location of the hub 88 on the shaft end may be adjusted to vary the compression of both of the springs 91 and 92.

Figure 3:
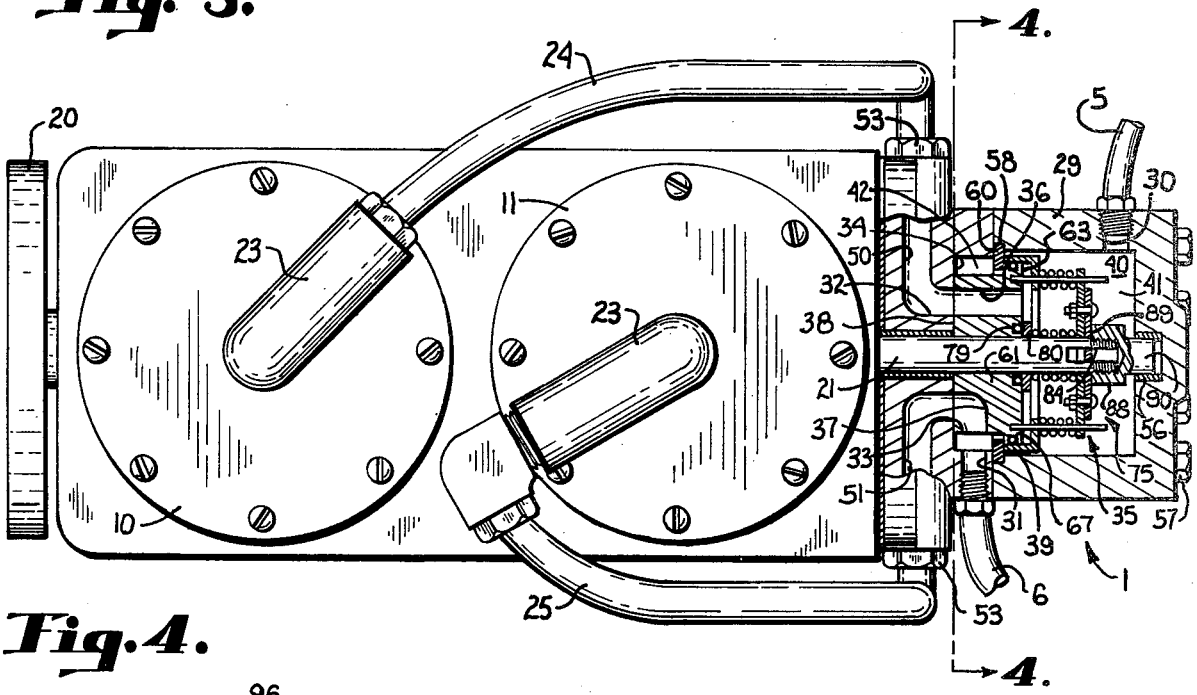
FIG. 3 is a top plan view of the engine and the valve, with portions thereof broken away.

In use, external energy is applied to the boiler 3, whereby the working fluid, such as Freon, is pressurized and directed therefrom through the conduit 5 to the inlet port 30 of the rotary control valve 1. The pressurized Freon fills the intake chamber 41 of the housing cavity 40, and in the orientation illustrated in FIG. 3, is directed through the pressure passageway 36 in the rotor, the housing passageway 50, and the conduit 24 to the cylinder 10. In this example, the pressure passageway 36 initiates communication with the distribution port 32 when the piston is approximately 12 degrees before top dead center. The power or expansion stroke of cylinder 10 continues until the trailing edge 94 of the pressure recess 64 completely seals the port 32, at which time, the illustrated piston assumes a position in the nature of 108 degrees below top dead center. The pressurized gasses are allowed to further expand until the cylinder reaches the bottom dead center position, at which time the leading edge 95 of the exhaust passageway 37 communicates with the distribution port 32 and directs the spent gasses through the exhaust chamber 42 and out the outlet port 31. The cylinder 10 is communicated with the exhaust passageway 37 until the trailing edge 96 of the latter completely seals the port 32, wherein the piston reassumes an orientation in the nature of 12 degrees before top dead center. The pressure passageway 36 immediately recommunicates with the port 32, and the cycle is repeated. Simultaneously with the pressurization and exhaust of cylinder 10, the cylinder 11 is similarily pressurized and exhausted in opposed timing, whereby when the first cylinder 10 is beginning its expansion stroke, the second cylinder 11 is beginning its exhaust stroke, and vice versa.

During the above described operation, the pressurized gasses which enter the intake chamber 41 of the housing cavity act on the rotor 61 to provide a variable pressure seal between the sealing faces 34 and 38. The compression of the spring 91 provides a constant, inward force on the rotor and applies pressure to and compresses the sealing faces 34 and 38 even at low engine operating pressures. In addition, during engine operation, the pressure of the Freon bodily urges the rotor 61 inwardly on the shaft 21 thereby applying a compressive force to the sealing faces 34 and 38 of the rotor and housing, thereby forming a secure and tight sliding seal therebetween. As the operating pressure of the engine increases, the pressure between the sealing faces 34 and 38 automatically increases in a proportionate amount to provide a secure seal even at high operating pressures. The coil springs 92 are adjusted in the manner similar to the coil spring 91 to a precompressed condition to apply pressure to the sleeve 70, such that the sliding surfaces will form a seal even at low operating pressures. As the operating pressure of the engine is increased, the pressure of the Freon applies additional force to the sleeve to improve the seal between the sliding surfaces. In a manner similar to the rotor, the pressure between the sliding surfaces increases automatically with the operating pressure of the engine.

To adjust engine timing, the operator simply loosens the fasteners 85, and while maintaining the shaft 21 in a stationary condition, rotates the plate 82 and rotor 35 to the desired position. The fasteners 85 are then resecured to maintain the newly timed position, and the valve is reassembled.

It is to be understood that while I have illustrated and described certain forms of my invention, it is not to be limited to the specific forms or arrangement of parts herein described and shown.

What I claim and desire to secure by Letters Patent is:

1. A rotary control valve for an expansion fluid driven engine having a cylinder and a piston therein; said valve comprising:

(a) a housing having a fluid inlet port, a fluid outlet port, a distribution port positioned at one end of said housing for communicating with said cylinder, and a first sealing face disposed about said distribution port;

(b) a drive shaft extending into said housing and rotatably mounted therein;

(c) a rotor positioned within said housing and forming a cavity between said rotor and said housing; said rotor being mounted on said drive shaft, and rotating with said drive shaft and translating axially with respect thereto; said rotor having:

(1) a peripheral surface, and a pair of end surfaces;

(2) a pressure passageway alternately communicating said distribution port with said fluid inlet port;

(3) an exhaust passageway spaced apart from said pressure passageway, and alternately communicating said distribution port with said fluid outlet port;

(4) a second sealing face positioned about one end of said pressure passageway and said exhaust passageway, and mating with said first sealing face to form a sliding seal therebetween;

(d) means rotating said drive shaft and said rotor in syncronization with the reciprication of said piston; and (e) a seal member sealing between the periphery of said rotor and said housing, and dividing said cavity into separate intake and exhaust chambers which respectively communicate with said intake and exhaust ports; said first and second sealing faces being positioned within said exhaust chamber, whereby operational fluid pressure urges said sealing faces abuttingly together with automatically varying compression and forms a secure sliding seal sequentially between said distribution port and said pressure and exhaust passageways.

2. A valve as set forth in claim 1 wherein said seal member further comprises:

(a) an O-ring mounted on the peripheral surface of said rotor; and (b) a sleeve sealingly mounted on said O-ring, and being slidable and concentric therewith; said sleeve having an end edge abutting a portion of an associated end of said housing, and being axially movable on said rotor, whereby operational fluid pressure urges said sleeve end edge against the associated housing end to form a sliding seal therebetween.

3. A valve as set forth in claim 1 including:

(a) a spring assembly mounted within said housing, operably connected with said rotor, and resiliently and constantly urging said first and second sealing faces together for seal security at low engine operation pressures.

4. A valve as set forth in claim 3 including:

(a) an O-ring mounted on the peripheral surface of said rotor;

(b) a sleeve sealingly mounted on said O-ring, and being slidable and concentric therewith; said sleeve having an end edge abutting a portion of an associated end of said housing, and being axially movable on said rotor, whereby operational fluid pressure urges said sleeve end edge against the associated housing end to form a sliding seal therebetween; and wherein (c) said spring assembly further includes resilient means constantly urging said sleeve end edge against the associated housing end.

5. A valve as set forth in claim 1 including:

(a) first and second timing adjustment plates selectively interconnected for adjusting the relative radial position therebetween; and wherein (b) said first plate is connected with said drive shaft for rotation and axial translation therewith; and (c) said second plate is connected with said rotor and transmits rotation of said drive shaft to said rotor.

6. A valve as set forth in claim 2 including:

(a) first and second pins having one end thereof connected with opposing sides of said rotor and extending axially thereof;

(b) first and second timing adjustment plates selectively interconnected for adjusting the relative radial position therebetween; and wherein (c) said first plate is connected with said drive shaft for rotation therewith; and (d) said second plate includes first and second apertures through which said first and second pins are respectively received, whereby said rotor rotates with said drive shaft and translates axially thereon.

7. A valve as set forth in claim 6 wherein:

(a) said sleeve includes a radially inwardly extending flange having first and second apertures in which said first and second pins are respectively received.

8. A valve as set forth in claim 7 including:

(a) resilient means extending between said sleeve flange and said second timing adjustment plate and urging the first and second sealing faces together for seal security.

9. In an expansion fluid driven engine having a cylinder and a piston therein, the improvement of a rotary control valve therefor; said valve comprising:

(a) a housing having a fluid inlet port, a fluid outlet port, a distribution port positioned at one end of said housing and communicating with said cylinder, and a first sealing face about said distribution port;

(b) a drive shaft extending into said housing and rotatably mounted therein;

(c) a rotor positioned within said housing and forming a cavity between said rotor and said housing; said rotor being mounted on said drive shaft, and rotating with said drive shaft and translating axially with respect thereto; said rotor having:

(1) a peripheral surface, and a pair of end surfaces;

(2) a pressure passageway alternately communicating said distribution port with said fluid inlet port;

(3) an exhaust passageway spaced apart from said pressure passageway, and alternately communicating said distribution port with said fluid outlet port;

(4) a second sealing face positioned about one end of said pressure passageway and said exhaust passageway, and mating with said second sealing face to form a sliding seal therebetween;

(d) means rotating said drive shaft and said rotor in syncronization with the reciprocation of said piston; and (e) a seal member sealing between the periphery of said rotor and said housing, and dividing said cavity into separate intake and exhaust chambers which respectively communicate with said intake and exhaust ports; said first and second sealing faces being disposed within said exhaust chamber, whereby operational fluid pressure urges said first and second sealing faces abuttingly together with automatically varying compression, and forms a secure sliding seal sequentially between said distribution port and said pressure and exhaust passageways to control the pressurizing and exhausting of said cylinder.

10. An engine as set forth in claim 9 wherein:

(a) said engine includes two opposingly timed cylinders and mating pistons, and a crankshaft connected to each of said pistons;

(b) said housing includes two diametrically positioned distribution ports, each communicating with a different one of the cylinders; and (c) said valve drive shaft is connected directly with the crankshaft and rotates therewith.

* * * * *